US012089798B2

(12) United States Patent
Pope, Jr.

(10) Patent No.: US 12,089,798 B2
(45) Date of Patent: Sep. 17, 2024

(54) MOBILE CART WITH HIGH-POWER SLURRY VACUUM AND CONTAINMENT

(71) Applicant: Refuse Materials, Inc., Ocilla, GA (US)

(72) Inventor: Donald A. Pope, Jr., Ocilla, GA (US)

( * ) Notice: Subject to any disclaimer, the term of this patent is extended or adjusted under 35 U.S.C. 154(b) by 29 days.

(21) Appl. No.: 17/749,592

(22) Filed: May 20, 2022

(65) Prior Publication Data

US 2023/0000296 A1 Jan. 5, 2023

Related U.S. Application Data

(60) Provisional application No. 63/217,922, filed on Jul. 2, 2021.

(51) Int. Cl.

| | |
|---|---|
| ***A47L 7/00*** | (2006.01) |
| ***A47L 5/14*** | (2006.01) |
| ***A47L 5/16*** | (2006.01) |
| ***A47L 9/32*** | (2006.01) |
| ***A47L 11/40*** | (2006.01) |

(52) U.S. Cl.

CPC ..... *A47L 7/0009* (2013.01); *A47L 5/14* (2013.01); *A47L 5/16* (2013.01); *A47L 11/4016* (2013.01); *A47L 11/4044* (2013.01); *A47L 9/325* (2013.01)

(58) Field of Classification Search

CPC . A47L 7/0009; A47L 5/14; A47L 5/16; A47L 11/4016; A47L 11/4044; A47L 9/325; B24B 7/18; B24B 7/22; B24B 55/10; B08B 5/04; B28D 1/003; B28D 7/02

See application file for complete search history.

(56) References Cited

U.S. PATENT DOCUMENTS

| | | | | |
|---|---|---|---|---|
| 2,553,034 A * | 5/1951 | William | A47L 11/4052 15/419 |
| 5,092,821 A * | 3/1992 | Gilbert | F04D 7/065 403/287 |
| 5,182,834 A * | 2/1993 | Wright | A47L 7/0019 96/406 |
| 6,023,813 A * | 2/2000 | Thatcher | A47L 11/4005 15/340.1 |
| 2007/0155285 A1* | 7/2007 | Padgett | B24B 7/186 451/350 |

* cited by examiner

*Primary Examiner* — David Redding

(74) *Attorney, Agent, or Firm* — Fishman Stewart PLLC

(57) ABSTRACT

A high-power slurry vacuum cart is well suited to collect and contain any slurry or wet residue produced through concrete and other surface processing operations. A multi-horsepower propane engine and propane tank are mounted on a mobile frame, along with a suction pump powered by the propane engine. A slurry containment vessel mounted on the frame has an input in communication with a squeegee and an output coupled to the suction pump. The squeegee may be adapted for floor contact to collect slurry for transfer to the slurry containment tank. The suction pump is directly coupled to the propane engine through a universal joint, thereby obviating the use of belts, chains or pulleys. The output of the pump may optionally be used as an air blower for surface drying, or the like, as well as use as an air blower to assist in emptying the slurry containment tank.

20 Claims, 2 Drawing Sheets

MOBILE CART WITH HIGH-POWER SLURRY VACUUM AND CONTAINMENT

REFERENCE TO RELATED APPLICATIONS

This application claims priority to and the benefit of U.S. Provisional Patent Application Ser. No. 63/217,922, filed Jul. 2, 2021, the entire content of which is incorporated herein by reference.

FIELD OF THE INVENTION

This invention relates generally to wet vacuuming and, in particular, to a mobile cart combining a propane engine, pump and containment vessel for collecting concrete slurry and other wet materials from floors.

BACKGROUND OF THE INVENTION

Polished concrete floors are becoming increasingly popular for retailers, big-box stores, educational and medical facilities, and even residential applications. Common uses include warehouses and warehouse outlets, hotels and restaurants, office buildings and showrooms. Benefits include low cost, resistance to wear, low maintenance, and aesthetic appeal in many situations. Polished concrete floors are easy to clean, and the glossy surface of polished concrete resists the marks of forklift truck tires and staining from oil and chemical spills. The glossy appearance of polished concrete is desirable for office building, hotels, restaurants, and other public facilities that want to project a bright, clean, professional image.

Various different types of machines are used to achieve a polished concrete floor, including riding and walk-behind coarse and fine grinders and polishers using wet and dry techniques. Machines are also available for stripping and removing old floors, filling in cracks, applying concrete overlays, as well as slurry and dust collection.

The polishing process itself proceeds through a series of mechanical and grinding stages utilizing professional equipment designed for these purposes. The process may also include the use of a concrete "densifier" which penetrates into the concrete to harden and dustproof the surface. The concrete surface is processed through a series of steps with grinding and polishing disks having progressively finer grits. The disks are typically fabricated with industrial diamonds in a bonded material such as metal, resin or a combination thereof, often referred to as "diamond polishing pads."

Typically the concrete goes through a process of grinding and polishing using aggressive equipment and abrasive elements or tooling, including pads of varying grit from 30 to 3,000. Concrete is considered "polished" until grits of 800 or finer are used, followed by finishing to 1500 3000-grit levels. The concrete may be ground without entering aggregate layers, or different sizes of aggregate may be exposed and polished to achieve different appearances. Dyes designed for concrete polishing are often applied to add color to polished concrete for borders, logos and decorative patterns. Such options provide a wide range of surface finish and color variations.

Concrete grinding and polishing begins with grinding pads or tools that have grits of 30, 70, and 120, which are used successively. These abrasive elements are rotated at a relatively slow speed during the grinding steps, e.g., at rotating speeds in the range of about 500 to 800 rpm. After grinding with the diamond pads, honing steps follow using grits of 50, 100, and 200, rotated at, for example, a speed of about 800 rpm. After about 200-grit honing step, dies or stains may be applied and, if necessary, a concrete densifier may be applied to the floor.

Polishing continues using a 400 grit or finer pad, with rotational speeds of the spindles and abrasive elements being in the range of about 800 to 1,100 rpm. The concrete will begin to develop a sheen, with the grit choice of the final polishing steps being dependent upon the reflection and shine desired. If the polishing process is continued through use of a 3000-grit pad, the concrete will assume a mirror-like finish. Burnishing may further promote a specular appearance. A topical sealer may be optionally applied to the finished floor.

The grinding and polishing steps may be dry or wet. With the latter, a water tank on-board the grinding/polishing machine delivers water to the diamond pads or resin pads through channels to the polishing head. With wet polishing, the generated slurry is collected with a squeegee, and with dry polishing the dust is collected with a vacuum. Typically, the polishing head is enclosed with a shroud that surrounds the rotating pads. A vacuum port is connected with a hose to an externally-provided vacuum, which may be nearby or wheeled alongside the grinding and polishing machine.

Although wet and dry techniques both have advantages and disadvantages, dry polishing tends to be faster, more convenient, and environmentally friendly. Wet polishing uses water to cool the diamond abrasives and eliminate grinding dust. The water acts as a lubricant to reduce friction, but cleanup is more involved. Wet polishing creates a tremendous amount of slurry that crews must collect and dispose of in an environmentally sound manner. With dry polishing, no water is required. Instead, the floor polisher is hooked up to a dust-containment system that vacuums up the mess.

In summary, the process of concrete floor polishing may include some or all of the following steps:

- Remove existing coating(s);
- Deposit new layer of concrete onto uneven or damaged floor,
- Seal cracks, joints or imperfections with an epoxy or other semi-rigid filler;
- Progressively grind with a 30/40-, 80- and 150-grit metal-bonded diamond pads;
- Optionally apply a chemical hardener to densify the concrete;
- Progressively polish with a 100/200-, 400- and 800-grit resin or metal-bonded diamond pads;
- Apply optional dye(s) for coloration;
- Finish with a 1500- or 3000-grit resin-bonded diamond pads to achieve a desired sheen level; and
- Optionally seal to help protect the polished surface and make it easier to maintain.

SUMMARY OF THE INVENTION

This invention improves upon the existing art by providing a high-power slurry vacuum cart. The system is well suited to collect and contain any slurry or wet residue produced through concrete and other surface processing operations including, without limitation, grinding, polishing, sawing, cutting, coring, sanding and drilling.

The inventive cart comprises a walk-behind mobile frame with a handle and wheels. A multi-horsepower propane engine and propane tank are mounted on the frame, along with a suction pump powered by the propane engine. A slurry containment vessel mounted on the frame has an input in communication with a squeegee and an output coupled to the suction pump. The squeegee may be adapted for floor contact to collect slurry for transfer to the slurry containment tank.

In the preferred embodiment, the suction pump is directly coupled to the propane engine through a universal joint, thereby obviating the use of belts, chains or pulleys. The propane engine also preferably includes a catalytic muffler, facilitating operation of the cart in enclosed environments.

The output of the pump may optionally be used as an air blower for surface drying, or the like, as well as use as an air blower to assist in emptying the slurry containment tank. The squeegee may be raised or lowered from a handle or other support for use.

DETAILED DESCRIPTION OF THE INVENTION

This invention improves upon the existing art by providing a mobile cart with a high-powered, low-emission wet vacuum and containment system. Slurry collection is currently performed inefficiently, using equipment designed more for clean water collection or janitorial type work, and this equipment cannot collect or process the thick slurry being generated during certain concrete processing operations.

In the preferred embodiment, the cart uses a propane engine directly coupled to a pump feeding a high-capacity containment vessel. The invention is directly suited to collection and containment of slurry generated during concrete grinding and polishing operations, though the equipment is applicable to any situation that would benefit from wet vacuuming and containment. For example, besides grinding and polishing, many operations, including coring, drilling, and sawing with hand tools performed in wet environments often leave wet reside that must be collected, contained and disposed of. This invention serves these goals.

Figure 1:
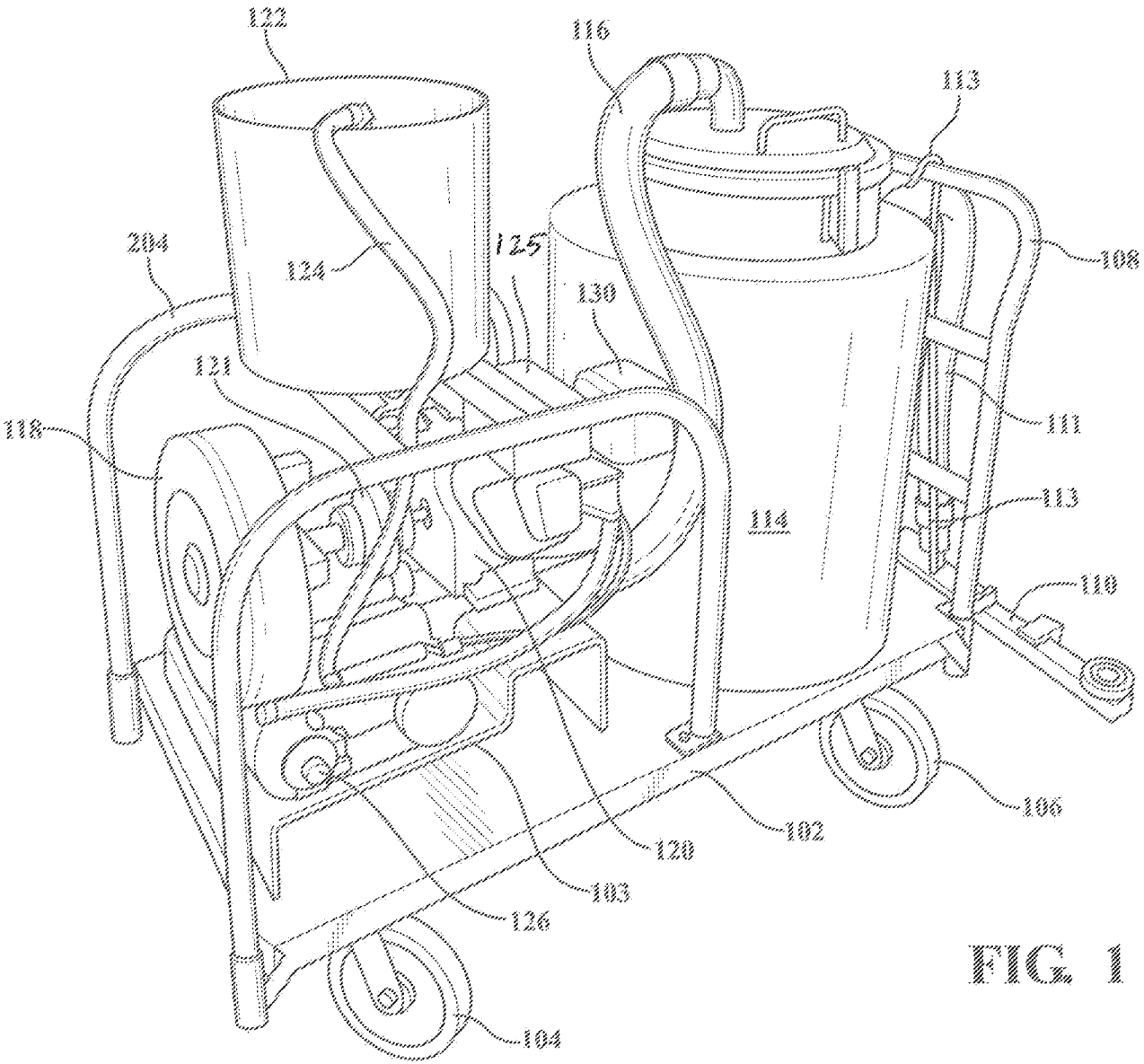
FIG. 1 is a first perspective view of a preferred embodiment of the invention.
Figure 2:
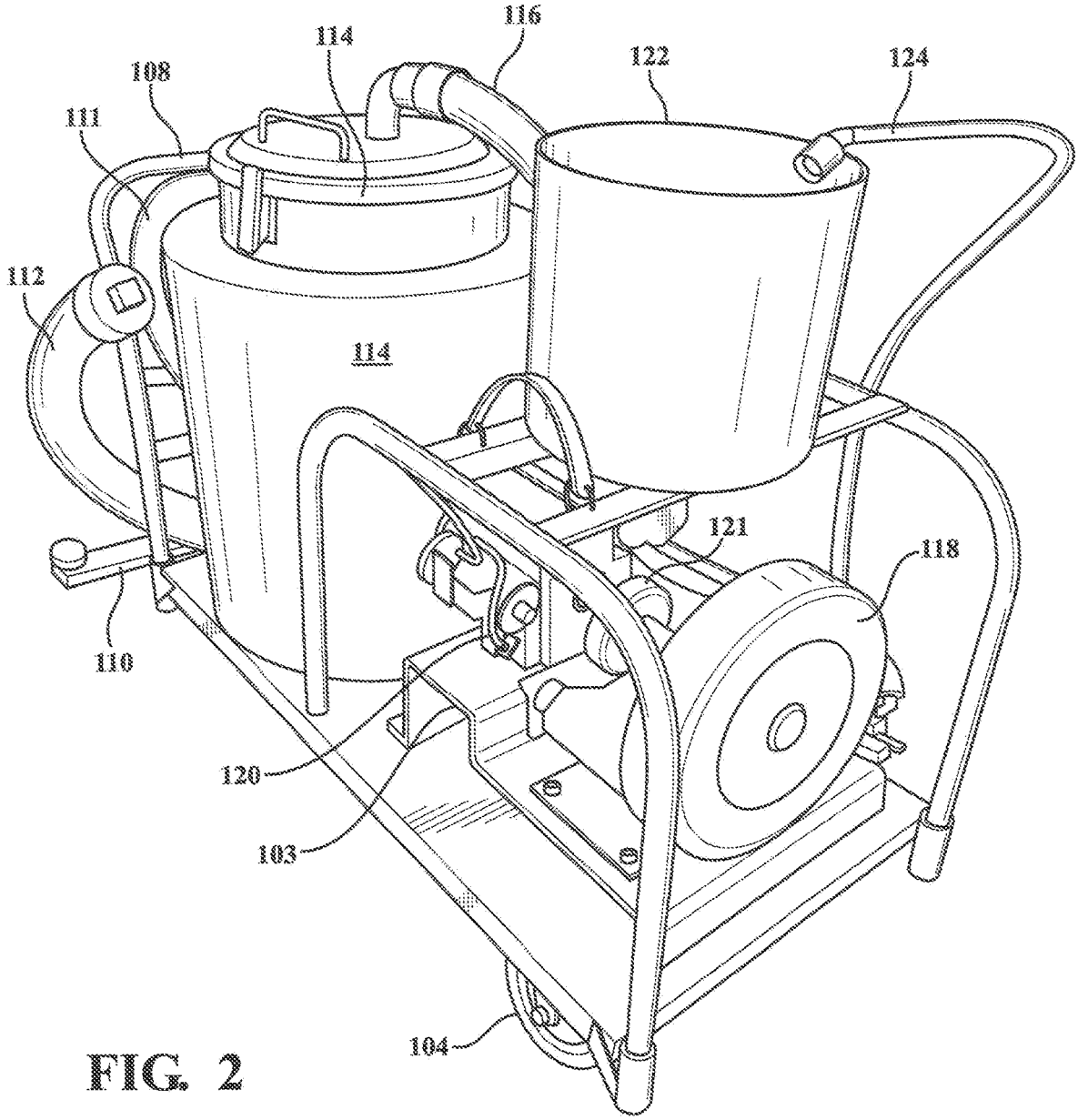
FIG. 2 is front perspective view of the preferred embodiment.

FIG. 1 is a first perspective view of a preferred embodiment of the invention, and FIG. 2 is a different perspective view. The system includes a lower frame 102 with wheels 104, 106 adapted for floor contact. The cart comprises a walk-behind system using handle 108, in which case the wheels 106 closest to the user are preferably casters to enhance maneuverability.

On the forward portion of the cart there is mounted a propane engine 120 which is directly coupled to pump 118 through universal joint 121. Note that in the preferred embodiment direct coupling is used in lieu of belts or chains that could require wear and maintenance. The motor 120 and pump 118 are preferably mounted on stepped subframe 103 to achieve desired alignment between the components. A battery and electric starter motor are also mounted on subframe 103. Motor 120 may be a 9-hp 205 cc propane engine manufactured by Briggs & Stratton, though other units may alternatively be used. Optional side bars 204 are preferably provided to protect the engine, pump and related components.

A holder 122 holds the propane tank (not shown), coupled to the engine 120 through high-pressure fuel line 124 through regulator 126. In the preferred embodiments, a catalytic muffler 125 is used to further reduce emission for enclosed environments. Pump 118 develops suction through hose 116 connected to containment vessel 114. The vessel 114 may comprise a 35-gallon vessel, though other sizes may alternatively be used.

The input to vessel 114 is, in turn, coupled to suction squeegee 110 through hose connection 111. For the sake of convenience, squeegee 110 hangs from handle bar 108 through hanger 113, enabling the operator to raise and lower the squeegee at will. While a straight squeegee is shown, curved devices may alternatively be used.

Note that a hose (not shown) may be attached to the output of pump 118, enabling the unit to function as a blower. Indeed, hose 116 may so configured for such purpose. The provision of a blower could serve various convenient purposes, including floor drying between wet grinding/polishing operations. Further, hose 116 may be connected to the output of the pump 118 to assist in emptying the tank 114 (through hose 112), as come collected slurries have a very thick, viscous consistency.

The invention claimed is:

1. A high-power slurry vacuum cart, comprising:
- a walk-behind mobile frame with a handle and wheels;
- a propane engine and propane tank mounted on the frame;
- a suction pump mounted on the frame and powered by the propane engine;
- a slurry containment tank mounted on the frame receiving suction from the suction pump;
- a squeegee in communication with the slurry containment tank, the squeegee being adapted for floor contact to collect slurry for transfer to the slurry containment tank;
- a suction hose connecting the suction pump to the slurry containment tank, and a hose connection connecting the slurry containment tank to the suction squeegee; and
- wherein the suction pump is directly coupled to the propane engine.

2. The slurry vacuum cart of claim 1, wherein the propane engine includes a catalytic muffler facilitating operation of the cart in enclosed environments.

3. The slurry vacuum cart of claim 1, wherein the suction pump is directly coupled to the propane engine without the use of belts, chains or pulleys.

4. The slurry vacuum cart of claim 1, wherein the suction pump is directly coupled to the propane engine through a universal joint.

5. The slurry vacuum cart of claim 1, wherein the output of the suction pump is optionally used as an air blower.

6. The slurry vacuum cart of claim 1, wherein the suction pump is disposed forward of the propane engine relative to the handle.

7. The slurry vacuum cart of claim 1, wherein the slurry is produced through a wet concrete processing operation.

8. The slurry vacuum cart of claim 7, wherein the wet concrete processing operation includes one or more of the following:
- grinding,
- polishing,
- sawing,
- cutting,
- coring, and
- drilling.

9. The slurry vacuum cart of claim 1, wherein the squeegee may be raised or lowered from the handle for use.

10. The slurry vacuum cart of claim 1, wherein the propane engine and the suction pump are mounted on a stepped subframe arranged on the mobile frame.

11. The slurry vacuum cart of claim 10, wherein the slurry containment tank is disposed on the frame between the stepped subframe and the handle.

12. The slurry vacuum cart of claim 1, further comprising a holder for holding the propane tank, and a high-pressure fuel line structured and arranged to couple the propane tank to the propane engine through a regulator.

13. A high-power slurry vacuum cart, comprising:

a walk-behind mobile frame with a handle and wheels;

a propane engine mounted on the frame;

a suction pump mounted on the frame and powered by the propane engine;

a slurry containment tank mounted on the frame receiving suction from the suction pump;

a squeegee in communication with the slurry containment tank, the squeegee being adapted for floor contact to collect slurry for transfer to the slurry containment tank; and wherein the propane engine and the suction pump are mounted on a stepped subframe arranged on the mobile frame.

14. The slurry vacuum cart of claim 13, wherein the suction pump is disposed forward of the propane engine relative to the handle.

15. The slurry vacuum cart of claim 14, wherein the slurry containment tank is disposed on the frame between the stepped subframe and the handle.

16. The slurry vacuum cart of claim 13, wherein the suction pump is directly coupled to the propane engine without the use of belts, chains or pulleys.

17. The slurry vacuum cart of claim 13, wherein the suction pump is directly coupled to the propane engine through a universal joint.

18. The slurry vacuum cart of claim 13, further comprising a holder for holding a propane tank, and a high-pressure fuel line structured and arranged to couple the propane tank to the propane engine through a regulator.

19. The slurry vacuum cart of claim 13, wherein the propane engine includes a catalytic muffler facilitating operation of the cart in enclosed environments.

20. A high-power slurry vacuum cart, comprising:

a walk-behind mobile frame with a handle and wheels;

a propane engine and propane tank mounted on the frame;

a suction pump mounted on the frame and powered by the propane engine;

a slurry containment tank mounted on the frame receiving suction from the suction pump;

a squeegee in communication with the slurry containment tank, the squeegee being adapted for floor contact to collect slurry for transfer to the slurry containment tank;

a holder for holding the propane tank, and a high-pressure fuel line structured and arranged to couple the propane tank to the propane engine through a regulator; and wherein the suction pump is directly coupled to the propane engine.

* * * * *